United States Patent [19]

Barchilon

[11] 3,939,963

[45] Feb. 24, 1976

[54] TYPE CORRECTION AID

[76] Inventor: John Barchilon, 556 Chapel St., New Haven, Conn. 06511

[22] Filed: Aug. 19, 1974

[21] Appl. No.: 498,275

[52] U.S. Cl. ..... 197/187

[51] Int. Cl.[2] ..... B41J 29/00

[58] Field of Search ..... 197/187, 188, 190, 180, 197/135 R, 135 A

[56] References Cited

UNITED STATES PATENTS

| | | | |
|---|---|---|---|
| 1,213,366 | 1/1917 | Hess | 197/187 |
| 3,179,227 | 4/1965 | Brown | 197/180 X |

OTHER PUBLICATIONS

IBM Technical Disclosure Bulletin, Vol. 11, No. 4, Sept. 1968, p. 390, Paper Insertion Realignment Mechanism.

*Primary Examiner*—Paul E. Shapiro

*Attorney, Agent, or Firm*—DeLio and Montgomery

[57] ABSTRACT

A device for use on a typewriter comprising a transparent sheet which is rotatable and translatable on the typewriter paper bar and may be positioned over a paper in the typewriter in front of type hammer striking position. The device aids in aligning a paper in the typewriter for insertion of a character in a previously typed paper.

5 Claims, 5 Drawing Figures

TYPE CORRECTION AID

BACKGROUND OF THE INVENTION

This invention relates to typewriters and more particularly relates to a device used in conjunction with a typewriter to aid in precisely locating a character space among other typewriter characters.

In many cases after a letter has been typed and proofread an error is found, after the paper is taken from the typewriter. To avoid completely retyping the page, the letter is reinserted into the typewriter, erasure made where necessary, and then an attempt is made to place the correct character in the erased space.

This is a very difficult procedure. Once the paper has been removed from the typewriter it is quite difficult to realign a given line correctly and also to locate the space in relation to the type hammer bearing the character to be inserted.

In some cases the foregoing problem arises even if the paper is not removed from the typewriter due to slippage of the paper as it is rolled in the typewriter, and/or the paper nearing the bottom.

The present invention overcomes these difficulties in alignment by providing a new and improved device which permits the typist to make a sample strike of the character to be inserted, which device is attached to the paper bar of the typewriter and may easily be moved between an operative and an inoperative position.

Briefly stated, the invention, in one form thereof, comprises a member which is slidable along the paper bar to a position where it is out of the way and does not interfere with typing. The device is also rotatable on the paper bar and has a transparent sheet which will extend behind the card holder or line guide. The transparent sheet is preferably curved, so as to be complimentary to the curvature of the roller or platen of the typewriter.

An object of this invention is to provide a new and improved device for enabling a typist to add a character in the proper spacing on a typewritten sheet of paper.

Another object of this invention is to provide such a device which is located on the typewriter and may be easily moved into and out of an operative position.

For a fuller understanding of the nature and objects of the invention, reference is made to the following description taken in conjunction with the accompanying drawings, in which.

Figure 1:
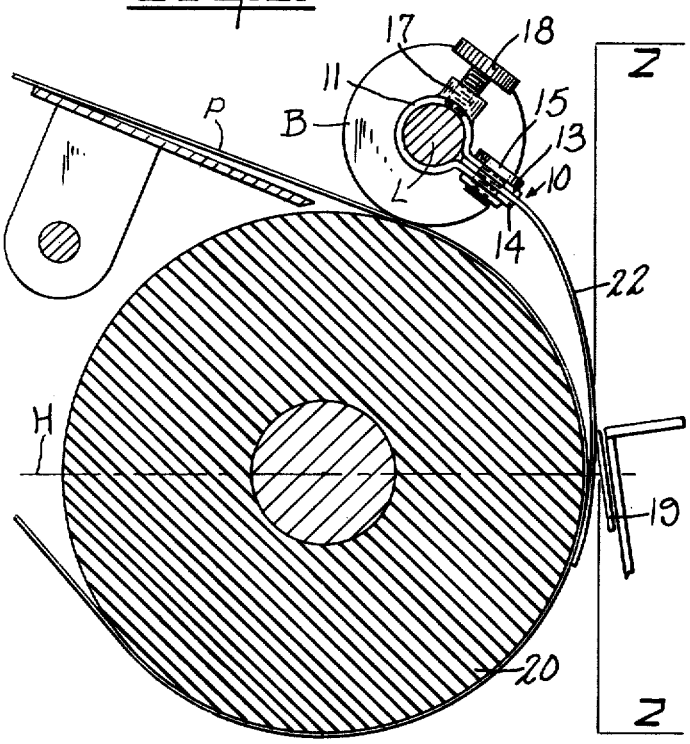
FIG. 1 is a side elevation, in section, of a device embodying the invention mounted to the paper bar of a typewriter.
Figure 2:
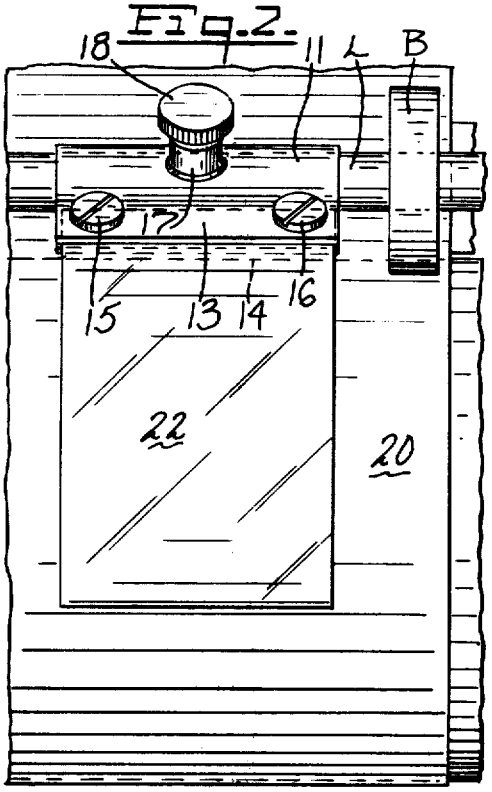
FIG. 2 is a front elevation of the device of FIG. 1 see in the plane of lines 2-2 of FIG. 1 in an operative position behind the line guide or card holder of a typewriter.
Figure 3:
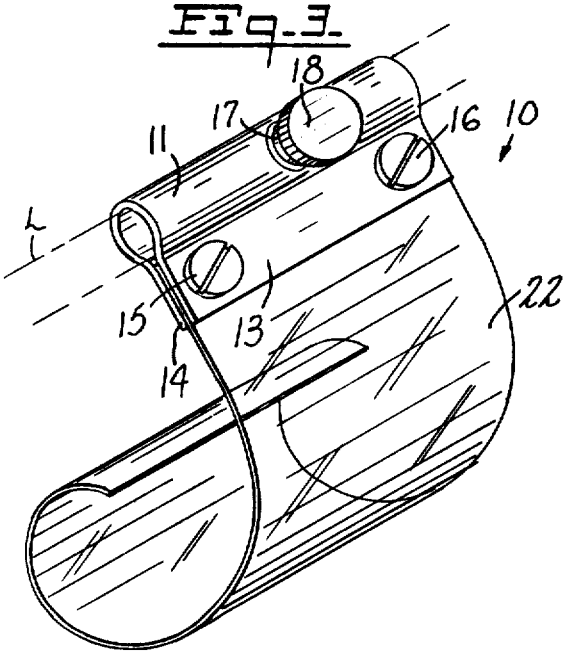
FIG. 3 is a perspective view of the device of FIGS. 1 and 2.

A device 10 embodying the invention includes a substantially circular mounting member 11 of resilient material which is formed to be expanded to fit about a paper bar L of typewriter. The bar L has the usual resilient paper holding bushings B thereon. The device includes projecting lips or flanges 13 and 14 which receive fastening screws 15 and 16 therethrough. A threaded boss 17 is defined on substantially circular portion 11 and threadably receives therein a thumb screw 18 which is designed to compressively engage paper bar L.

Screws 15 and 16, which have a slot large enough to be easily operated by a secretary with a small coin, hold a transparent sheet 22 between flanges 13 and 14 designed to fit behind line guide or card holder 19 of a typewriter and over platen or roller 20 and a paper P thereon. With this arrangement when thumb screw 18 is loosened the housing member 11 may easily be slid along the paper bar L and may also be rotated upwardly to an inoperative position at the end of the bar. The transparent sheet may be polyethylene or other suitable material.

To insert the sheet 22 the device is rotated downwardly to an operative position as shown in FIG. 1 and then slid along the bar behind the line guide or card holder 19, the sheet of paper is located and then the appropriate key for insertion may be struck. The character is then imprinted on the transparent sheet 22 and the typist may then look at the character in relation to the paper to determine that the character and paper are correctly located. After the character has been correctly located, thumb screw 18 is loosed, the device is slid to an inoperative position and then rotated upwardly and the correct character is then typed in the located space.

The radius of curvature of the transparent plastic sheet 22 is preferably less than that of the platen in order to keep the sheet 22 against the paper when in an operative position and preferably it is formed on a radius about one-half that of the platen. The sheet is sufficiently long to extend downwardly beyond a horizontal plane H through the axis of the platen.

The transparent sheet may be made of almost any thermoplastic material which may be set on a radius. In this case, polyethylene, polypropylene or vinyl in sheet form may be heated to approximately 325° F. or greater, formed on a mandrel and cooled. The plastic which retains some elastic memory expands to a slightly larger radius than that in which it was heat set. However, the recovered radius will still be less than the radius of the platen by the desired amount.

Figure 4:
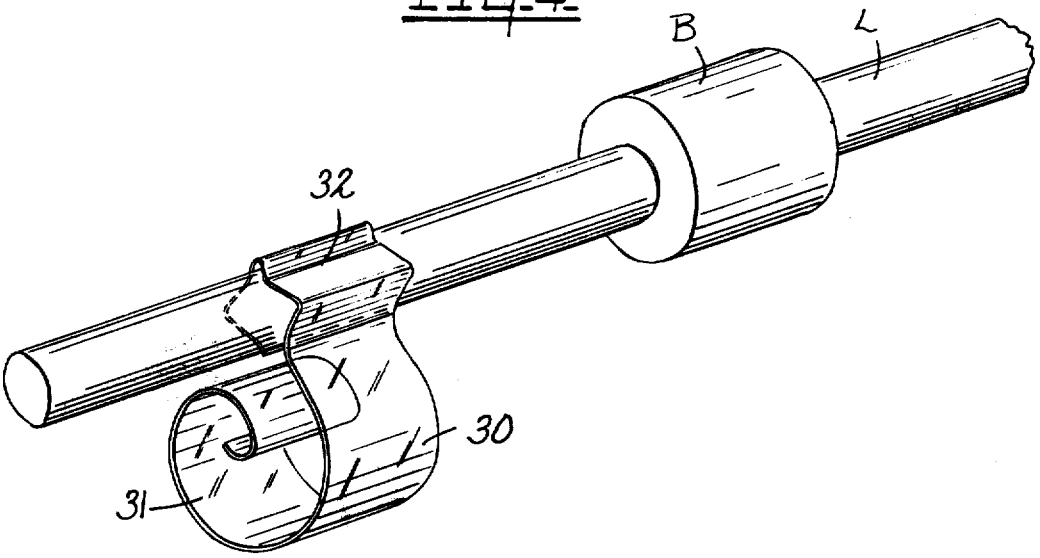
FIG. 4 is a perspective view of another emodiment of the invention.

FIG. 4 shows the invention embodied in a one-piece transparent strip 30 which is formed with a lower curved portion 31. The upper portion of the strip 30 is formed so as to engage and be retained on the paper bar L but is rotatable and slidable thereon. As shown, the upper portion 32 is formed so as to have a cross-section which may be considered to be generally diamond or star shaped and with dimensions between opposing sides thereof which is less than the diameter of the paper bar. The material is flexible and the upper portion 32 may be easily fitted about paper bar L. The upper portion 32 could also be formed in a general circular shape wrapping around more than 360°.

Figure 5:
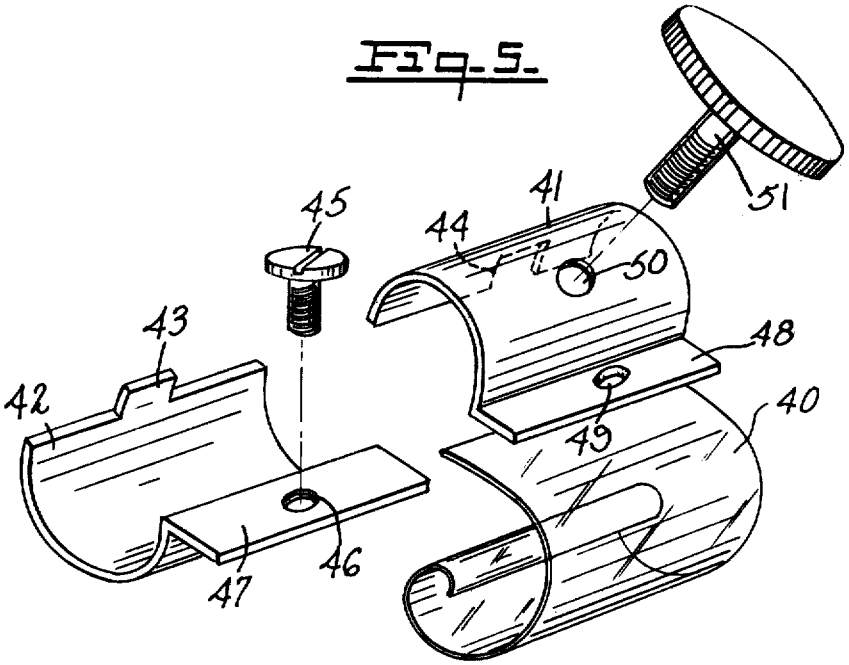
FIG. 5 is a perspective view of still another embodiment of the invention.

FIG. 5 discloses still another embodiment of the invention wherein the holder for a transparent strip 40 is formed in two parts 41 and 42. An aligning tongue 43 on part 42 is adapted to fit into a groove 44 in part 41. The parts are held together by means of screw 45 which is threadably received in a bore 46 in the lip or flange 47 of part 42 and extends through lip or flange 48 and bore 49 therein through strip 40, to bore 46. A threaded bore 50 is also provided in generally hemispherical cross-sectional part 41 to receive a thumb screw 51 to clamp the holder comprising parts 41 and 42 to paper bar L. Thus, when thumb screw 51 is tightened, the holder is locked in position on the letter bar L, but when loosened the holder may be rotated about the letter bar and translated along the length thereof.

The thickness of the transparent sheet or strip may be on the order of about 0.010 inch, but any thickness sheet which may be suitably formed and fit behind the line guide is acceptable.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. An aid for positioning a paper in a typewriter which includes a line guide, a paper bar and a paper platen where the paper bar has bushings thereon which space the bar from the platen; said aid comprising a transparent strip of material having at least a portion thereof shaped on a radius of curvature less than the radius of curvature of the platen, means on said strip attachable to a paper bar so that said strip is rotatable and slidable on the paper bar, said strip extendible from a paper bar with the smaller radius portion over and about a platen behind a line guide.

2. The aid of claim 1 wherein said means attachable is a continuation of the strip formed to engage the paper bar.

3. The aid of claim 1 wherein said means attachable comprise a member positionable about the paper bar, means for locking said member on the paper bar, and means extending from said member for holding said strip.

4. The aid of claim 3 wherein said means attachable is formed in one piece of resilient material and has a generally cylindrical portion for receiving the paper bar therein and said means extending is a pair of flanges holding an end of said strip therebetween.

5. The aid of claim 3 wherein said means attachable is formed in two parts each having a flange, and means extending through said flanges to hold said two parts together about the paper bar and the strip between the flanges.

* * * * *